United States Patent [19]

Matsumura

[11] 4,416,206

[45] Nov. 22, 1983

[54] CONTROL FOR AUTOMATIC BUTTONHOLE APPARATUS IN ZIGZAG SEWING MACHINE

[75] Inventor: Nobuyoshi Matsumura, Yao, Japan

[73] Assignee: Maruzen Sewing Machine Co., Ltd., Osaka, Japan

[21] Appl. No.: 271,572

[22] Filed: Jun. 8, 1981

[30] Foreign Application Priority Data

Sep. 5, 1980 [JP] Japan ..... 55-123810

[51] Int. Cl.[3] ..... D05B 3/06

[52] U.S. Cl. ..... 112/158 B; 112/277

[58] Field of Search ..... 112/158 B, 168, 158 E, 112/240, 277

[56] References Cited

U.S. PATENT DOCUMENTS

| | | | |
|---|---|---|---|
| 3,926,133 | 12/1975 | Herron et al. . | |
| 4,048,932 | 9/1977 | Odermann et al. | 112/158 E |
| 4,182,249 | 1/1980 | Matumura et al. | 112/158 B |
| 4,248,167 | 2/1981 | Reinert | 112/277 X |
| 4,289,084 | 9/1981 | Takenoya et al. | 112/158 E |

*Primary Examiner*—Werner H. Schroeder
*Assistant Examiner*—Andrew M. Falik
*Attorney, Agent, or Firm*—Lowe, King, Price & Becker

[57] ABSTRACT

A detection circuit senses whether a buttonhole type presser foot is attached to a sewing machine presser bar and through a control circuit enables or disables pattern selection switches for machine operation other than a buttonholing mode.

13 Claims, 10 Drawing Figures

CONTROL FOR AUTOMATIC BUTTONHOLE APPARATUS IN ZIGZAG SEWING MACHINE

BACKGROUND OF THE INVENTION

1. Field of the Invention

The present invention relates to an automatic buttonholing apparatus in a zigzag sewing machine. More specifically, the present invention relates to an automatic buttonholing apparatus in a zigzag sewing machine using a separate attachment in buttonholing.

2. Description of the Prior Art

FIG. 1 is a diagram showing one example of a buttonhole depicting the background of the invention. As shown, bar tack portions 21 and 22 are formed at upper and lower ends of a buttonhole 1. The left side 23 and the right side 24 of the buttonhole 1 are hemstitched with a predetermined width completing the buttonhole. During buttonholing, it is necessary to fix an attachment such as a cloth present (not shown in FIG. 1).

FIG. 2 is a perspective view showing a buttonhole guide foot portion which constitutes the background of the invention. The buttonhole guide foot comprises a U-shaped shoe 3 and a presser foot 4. The pressure foot 4 comprises a shank 6 fixed to a presser bar 5 by means of a screw 6*a* and a sliding foot 7 such as a plastic foot pivoted to the shank 6, wherein the sliding foot 7 is loosely and slidably inserted into the shoe 3. A needle plate 10 having a needle hole 9 for thrusting of a needle 8*a* mounted to a needle bar 8 is positioned at the lower portion of the shoe 3. The attachment for pressing a cloth being buttonholed is thus provided; however, since such a buttonhole guide foot is already well-known a more detailed description will be omitted.

With such a conventional zigzag sewing machine as described above, it is required that buttonholing need be effected after the attachment, i.e. the cloth presser is mounted to the pressing bar. On the other hand, such a zigzag sewing machine is provided with a selection switch, not shown, for selecting a buttonholing mode or a pattern sewing mode, such as a general straight stitch, zigzag or superzigzag pattern. If it is desired to sew in a straight line, a selection button is depressed for straight stitch. Then a bight (a swinging width)and a feed (a cloth feed) for straight stitch are set in the sewing machine. The same applies to sewing of other zigzag patterns. If it is desired to make a buttonhole, the machine operator actuates a selection button for buttonholing. However, in the absence of a cloth presser as shown in FIG. 2, buttonholing as shown in FIG. 1 cannot be achieved. Accordingly, it is necessary to affix such an attachment when the selection switch for buttonholing is operated. In other words, if and when the sewing machine is operated, with such cloth presser provided, by operating the pattern selection switch, a sewing needle may come into contact with a portion of the cloth presser on a seam may become improper. Accordingly, it is necessary to force an operator to affix the attachment during buttonholing and conversely to remove the attachment during pattern sewing.

SUMMARY OF THE INVENTION

In summary, the present invention is adapted such that detection is made in a sewing machine as to whether an attachment is mounted to a presser bar. In response, with the attachment mounted, selection of patterns other than a buttonholing pattern is disabled. The sewing machine is thereby prevented from operating in other than a buttonholing pattern with the attachment, avoiding collision of a sewing needle with the attachment and preventing improper seams.

In a preferred embodiment of the present invention, a selection switch for buttonholing is not enabled unless the attachment is mounted. Therefore, according to the embodiment, buttonholing operation without the attachment is prevented.

Accordingly, a principal object of the present invention is to provide an improved automatic buttonholing apparatus in a zigzag sewing machine.

Another object of the present invention is to provide an automatic buttonholing apparatus for a zigzag sewing machine, wherein selection of patterns other than a buttonholing pattern is disabled when an attachment is mounted.

A further object of the present invention is to provide an automatic buttonholing apparatus in a zigzag sewing machine, wherein a selection switch for buttonholing is enabled only if the attachment is mounted.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 3:
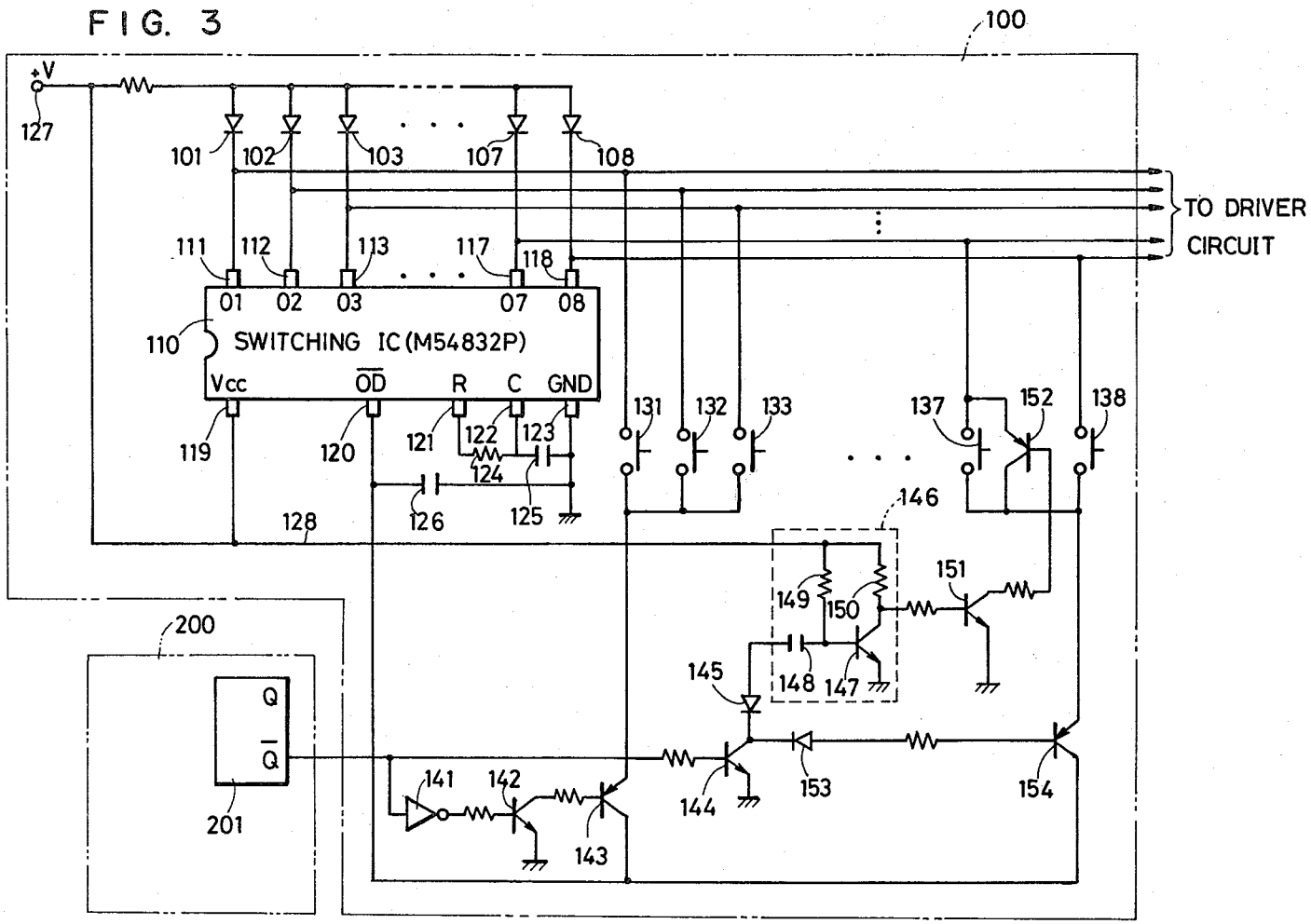
FIG. 3 is a schematic diagram of one embodiment of the present invention.

FIG. 3 is a schematic diagram showing one embodiment of the present invention. Briefly described, the embodiment comprises a control circuit portion 100 and a detecting circuit portion 200 for providing a signal representing presence/absence of an attachment being mounted to the controlling circuit.

The controlling circuit portion 100 comprises a switching integrated circuit 110. The switching integrated circuit 110 may be integrated an integrated M54832P (8-channel selector) manufactured by Mitsubishi Electric Co., Ltd., Japan. The switching integrated circuit 110 has eight output terminals 111 to 118, for example. Corresponding outputs may be obtained from these output terminals 111 to 118 responsive to operation of any of selection switches 131 to 138, to be described subsequently, which outputs are applied as enabling signals of a driving circuit, not shown. Light emitting diodes 101 to 108 are provided between these output terminals 111 to 118, respectively, and a power supply 127. Accordingly, if and when an output signal is obtained from any of these output terminals 111 to 118, i.e. any of the selection switches 131 to 138 is operated, the corresponding light emitting diode is energized, whereby the sewing mode being presently selected is displayed. The switching integrated circuit 110 is further provided with a power supply terminal 119, which is connected to a power supply line 128 connected to the power supply 127. The switching integrated circuit 110 further comprises a terminal 120 ($\overline{OD}$), which constitutes an output detecting input terminal for detecting which of the output terminals 111 to 118 is providing an output, thereby to perform a lock up function. Terminals 121 and 122 of the switching integrated circuit 110 are terminals for connection of external components 124 and 125 of an oscillator for scanning the respective outputs within the integrated circuit. A terminal 123 of the intergrated circuit 110 serves as a ground terminal and a capacitor 126 for absorbing switching noise developed by the selection switches 131 to 138 is connected between the terminals 123 and 120.

The selection switches 131 to 138 are interposed between the output terminals 111 to 118, respectively, and the output detecting input terminal 120 of the switching integrated circuit 110. Out of these selection switches 131 to 138, the selection switches 137 and 138 are structured as switches for selecting buttonholing, whereas the remaining selection switches 131, 132, 133, . . . are structured as selection switches for pattern sewing. For example, the switch 131 is structured as a selection switch for a straight stitch, the switch 132 is structured as a selection switch for a zigzag pattern, and the switch 133 is structured as a selection switch for a superzigzag pattern. One end of each of these selection switches 131, 132, 133, . . . for pattern sewing is individually connected to each of the corresponding output terminals 111, 112, 113, . . . , while the other end of each of the selection switches is commonly connected to the emitter of a switching transistor 143. On the other hand, the switch 137 is structured as a large buttonhole selecting switch, while the switch 138 is structured as a small buttonhole selecting switch for selecting buttonholing for a small diameter button. One end of the large buttonhole selecting switch 137 and of the small button hole selecting switch 138 is connected to each of the corresponding output terminals 117 and 118, respectively, while the other end is commonly connected to the emitter of a switching transistor 154. The collector of the above described switching transistor 143 and the collector of the switching transistor 154 are commonly connected to the output detecting input terminal 120 of the above described switching integrated circuit 110. Accordingly, if and when any of the selection switches 131, 132, 133, . . . is operated in the case where the switching transistor 143 is rendered conductive, a closed loop is formed between the corresponding output terminal and the input terminal 120, whereby an output from the corresponding output terminal is locked up. On the other hand, if and when any of the selection switches 137 and 138 is operated in the case where the switching transistor 154 is rendered conductive, a closed loop is formed between any of the corresponding output terminals 117 and 118 and the input terminal 120, whereby the output of any of the output terminals is locked up.

Conduction or non-conduction of the above described switching transistors 143 and 154 is basically controlled responsive to the output of a flip-flop 201 included in the detecting circuit portion 200. The output $\overline{Q}$ of the flip-flop 201 is connected to the base of the transistor 142 through an inverter 141 and a resistor. At the same time, the output $\overline{Q}$ is connected to the base of the transistor 144 through a resistor. The emitter of the transistor 142 is connected to the ground, while the collector of the same is connected to the base of the above described switching transistor 143 through a resistor. On the other hand, the emitter of the transistor 144 is connected to the ground, while the collector thereof is connected to the base of the above described switching transistor 154 through a diode 153 in the reverse direction and a resistor. Furthermore, the collector of the transistor 144 is connected to a monostable multivibrator 146 through a diode 145 in the reverse direction. The monostable multivibrator 146 comprises a transistor 147 and a capacitor 148 is connected between the base of the transistor 147 and the diode 145. Resistors 149 and 150 are connected to the base and the collector, respectively, of the transistor 147 and the power supply line 128, while the emitter of the transistor 147 is connected to the ground. The collector of the transistor 147, i.e. the output of the monostable multivibrator 146 is connected to the base of the transistor 151 through a resistor. The emitter of the transistor 151 is connected to the ground and the collector thereof is connected to the base of the transistor 152 through a resistor. The emitter and the collector of the transistor 152 are connected to both ends, respectively, of the buttonhole (large) selection switch 137.

Figure 1:
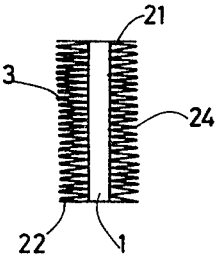
FIG. 1 PRIOR ART
FIG. 1 is a view showing one example of buttonholing which constitutes the background of the invention.
Figure 2:
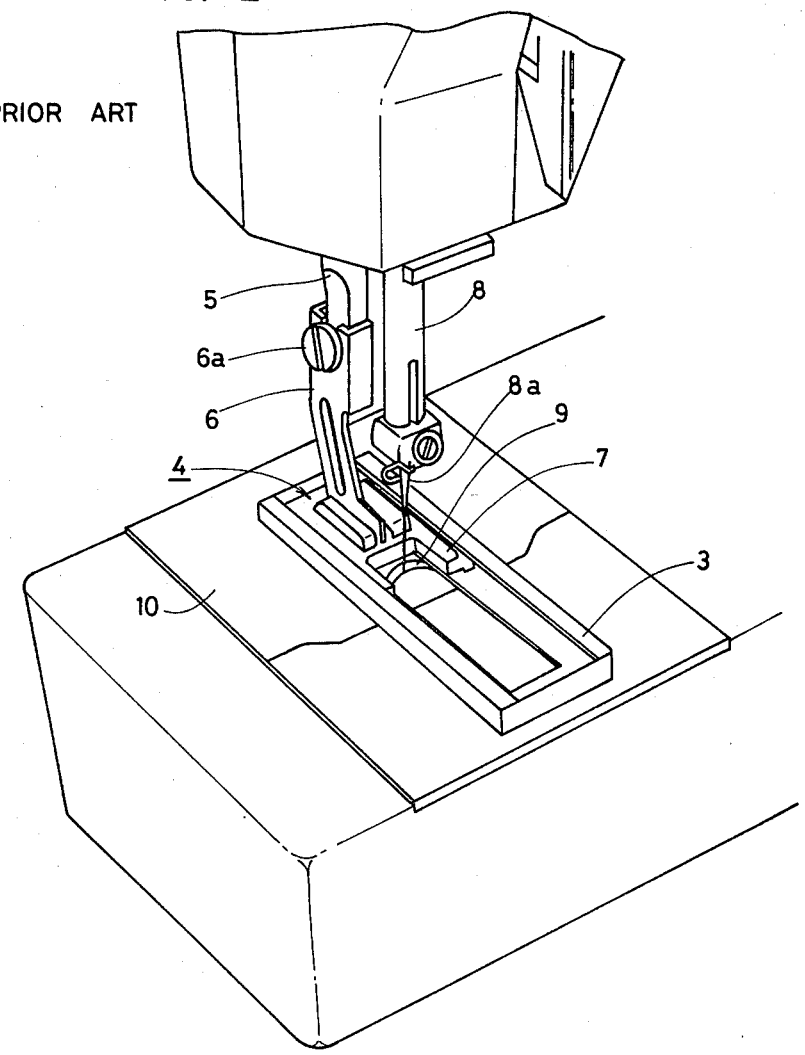
FIG. 2 PRIOR ART
FIG. 2 is a partial perspective view showing an attachment (a buttonhole guide foot) and portions associated therewith.

The flip-flop 201 included in the above described detecting circuit portion 200 is structured such that the output $\overline{Q}$ thereof is obtained in the high level, when the attachment (the buttonhole guide foot) is fixed to the presser bar 5, as shown in FIG. 2, for example, more fully described subsequently. Accordingly, if and when the attachment is removed, the output $\overline{Q}$ is the low level.

In the case where the attachment has not been affixed, the output $\overline{Q}$ of the flip-flop 201 is the low level. Accordingly, the output of the inverter 141 becomes high and the transistor 142 is rendered conductive. The switching transistor 143 is rendered conductive responsive to conduction of the transistor 142. The fact that the switching transistor 143 is thus rendered conductive means that the selection switches 131, 132, 133, . . . of the pattern sewing are rendered effective. Since the transistor 144 provides the low level from the output $\overline{Q}$ at that time, the same remains cut off and accordingly the switching transistor 154 is not rendered conductive. The fact that the switching transistor 154 thus remains cut off means that the buttonholing selection switches 137 and 138 have been rendered ineffective.

In the case where the attachment is affixed, the output $\overline{Q}$ of the flip-flop 201 turns to the high level. Accordingly, the switching transistor 143 is cut off. Cutting off of the switching transistor 143 means that the operation of the pattern sewing selection switches 131, 132, 133, . . . are rendered ineffective and at that time an operation of any of these switches 131, 132, 133, . . . does not result in application of a signal from any of the corresponding output terminals 111, 112, 113, . . . to the input terminal 120. On the other hand, at that time the transistor 144 is rendered conductive. Accordingly, it follows that the cathodes of the diodes 145 and 153 are connected to the ground potential, whereby the switching transistor 154 is rendered conductive.

At the same time a charging current flows from the power supply line 128 through the resistor 149 to the capacitor 148. Thereafter such charging current flow ceases. Accordingly, the transistor 147 is cut off for a predetermined short period of time which is determined depending upon the charging time constant of the capacitor 148 and accordingly the transistors 151 and 152 are rendered conductive for that predetermined short period of time. Conduction of the transistor 152 means a state equivalent to an operation of the buttonhole (large) selection switch 137, wherein connection state is established for the above described. The output terminal 117 and the output terminal 120 of the switching integrated circuit 110 are connected together for the above predetermined short time period and accordingly thereafter the output of the output terminal 117 is locked up. Thus, according to the embodiment shown, when the attachment is fixed, the circuit is forced to operate as if one selection switch 137 is actuated, without regard to operation of the selection switches 137 and 138. As a result, the buttonhole (large) sewing mode is automatically set without operating these selection switches 137 and 138. If an operator desires the buttonhole (small) sewing, he operates the switch 138. Then a closed loop is formed between the output terminal 118 and the input terminal 120, whereby a signal is obtained from the output terminal 118 and thereafter is locked up. Lock up is established because the output from the monostable multivibrator 146 has turned to the low level and accordingly the transistor 152 has been cut off. Meanwhile, when the attachment is fixed, as in the case of the embodiment shown, automatic setting of the buttonhole (large) sewing mode is not specifically required and the same may be reversed or may be dispensed with.

Thus, the selection switches 137 and 138 are rendered effective or the selection switches 131, 132, 133, . . . are rendered effective whether or not the attachment is fixed.

Now several preferred embodiments of the circuit portion 200 for detecting whether the attachment is fixed will be described.

Figure 4:
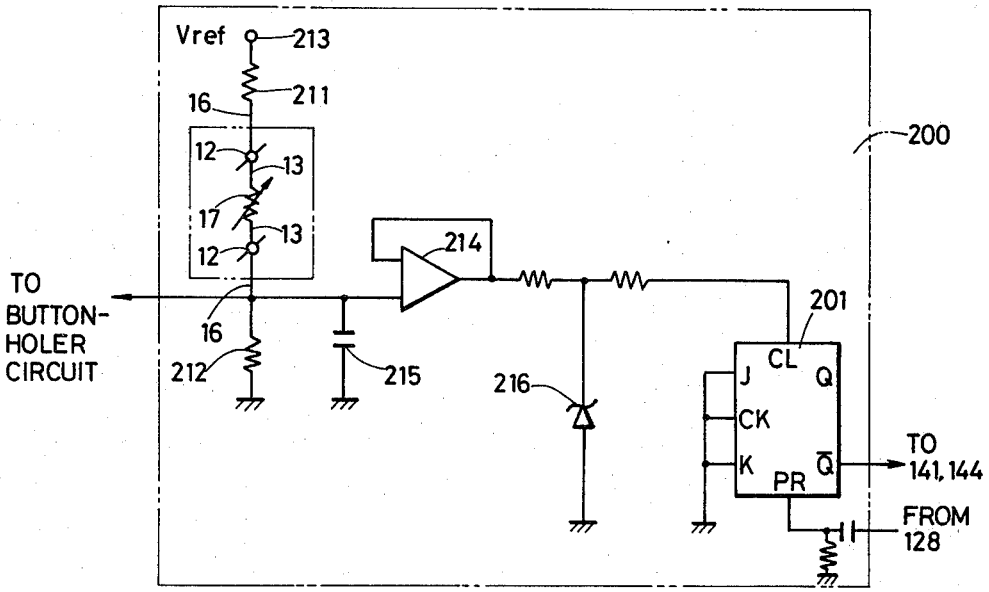
FIG. 4 is a schematic diagram showing a preferred embodiment of a detecting circuit.
Figure 5:
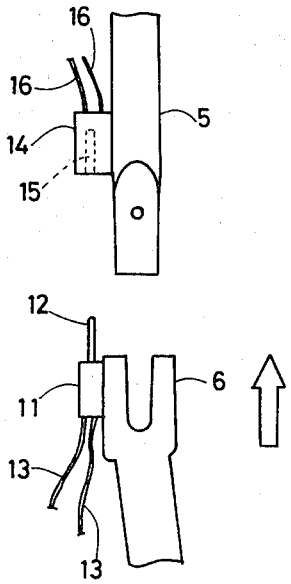
FIG. 5 is a diagrammatic view showing one example of a structure allowing for such detection.

FIG. 4 is a schematic diagram showing a preferred embodiment of the detecting circuit. The embodiment shown may be applied to an automatic buttonholing apparatus adapted such that a variable resistor, not shown, is fixed to the shoe 3 for automatically determining the button size and the slider thereof is moved in accordance with the cloth feeding, as disclosed as one embodiment in U.S. Pat. No. 4,182,249, for example. In order to implement such detecting circuit 200, a plug 11 is provided on the shank 4, as shown in FIG. 5, and a receptacle 14 is provided on the presser bar. The plug 11 is provided with a plug pin 12 for insertion to a hole 14 provided in the receptacle 14. A connection lead 13 is connected to the plug pin 12 and a connection lead 16 is connected to the hole 15. A variable resistor (not shown) fixed to the shoe shown in FIG. 2A of the above described U.S. Pat. No. 4,182,249 is connected to both ends of the connection lead 13. On the other hand, one connection lead 16 is connected at one end of a resistor 211 and the other connection lead 16 is connected at one end of a resistor 212. The other end of the reisitor 211 is connected to a reference voltage source (Vref) 213 and the other end of the resistor 212 is connected to ground. When the shank 6, i.e. the buttonhole guide foot (attachment) is mounted to the presser bar 5, the plug pin 12 is fitted into the hole 15 and the connection leads 13 and 16 are connected. Therefore, a current path including the resistor 211, the variable resistor 17 and the resistor 212 is formed between the reference voltage source (Vref) 213 and ground. One end of the resistor 212 is connected to a buttonholing circuit as shown in FIG. 2A of the above described U.S. Pat. No. 4,182,249, for example, and is also connected to a buffer amplifier 214. A capacitor 215 for absorbing a click noise is connected to both ends of the resistor 212. Accordingly, when the plug pin 12 is inserted into the hole 15, the reference voltage Vref is divided by the resistors 211 and 17 and the resistor 212 and the divided voltage is applied to the buffer amplifier 214. The output of the buffer amplifier 214 is applied through a clipper circuit 216 to the clear input CL of the flip-flop 201 described previously. The inputs J and K and the clock input CK of the flip-flop 201 are commonly connected to the ground. The preset input PR of the flip-flop 201 is connected to the power supply line 128 through a well-known resetting circuit. The flip-flop 201 is brought to a cleared state when the high level voltage is provided from the buffer amplifier 214 and thus from the clipper circuit 216, whereby the set state so far established by the preset signal is reversed so that the output $\overline{Q}$ turns to the high level. Thus, fixing of the attachment is detected.

Figure 6:
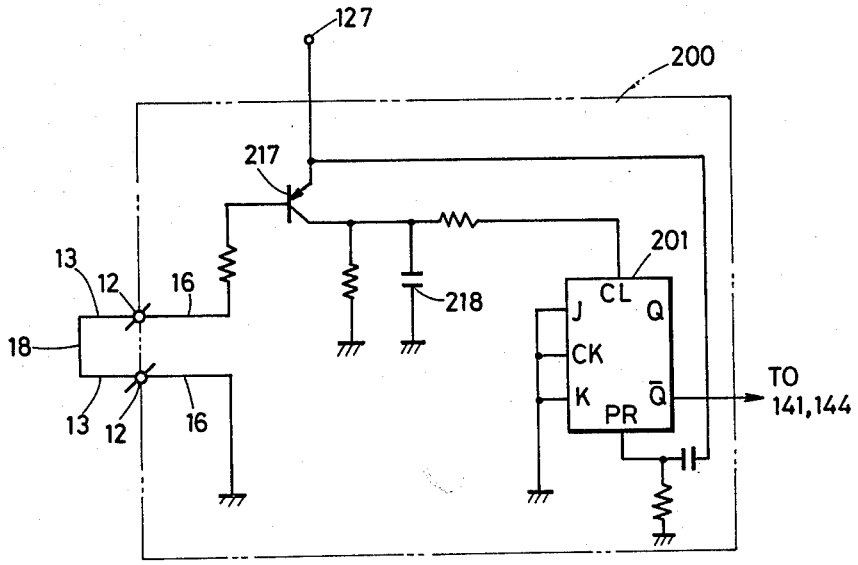
FIG. 6 is a schematic diagram showing another preferred embodiment of a detecting circuit.

FIG. 6 is a schematic diagram of another preferred embodiment of the detecting circuit. The embodiment shown may be applied not only to such an automatic buttonholing apparatus as disclosed as one embodiment in U.S. Pat. No. 4,182,249 described previously but also to that disclosed as the other embodiment in the above described U.S. Pat. No. 4,182,249. The automatic buttonholing apparatus disclosed as the other embodiment in FIG. 10 of the above described U.S. Pat. No. 4,182,249 utilizes a pulse generator for generating a pulse signal responsive to sliding of the shoe, without employing a variable resistor as in the case of FIG. 2A embodiment of the above described U.S. Pat. No. 4,182,249, thereby to make cloth feeding and fundamental line conversion. The FIG. 6 embodiment does not employ the variable resistor 17 as in the case of the previously described FIG. 4 embodiment. A jumper wire 18 is connected to the connection lead 13 shown in FIG. 5 as a short-circuiting member in place of the above described variable resistor. The detecting circuit is provided with a transistor 217 and the base circuit of the transistor 217 has been in advance opened such that a current path may be formed when the attachment is fixed to the presser bar and the plug pin 12 is connected to the hole 15 and accordingly the jumper wire 18 is connected. The emitter of the transistor 217 is connected to the voltage source (+V) 127 and the collector thereof is connected to the clear input CL of the flip-flop 201. Meanwhile, a capacitor 218 for absorbing noise is connected between the collector of the transistor 217 and the ground. When the plug pin 12 is inserted into the hole 15 in the embodiment shown, the jumper wire 18 closes the base circuit of the switching transistor 217. Accordingly, the switching transistor 217 is rendered conductive and the collector thereof is supplied with the high level voltage. Accordingly, the output $\overline{Q}$ of the flip-flop 201 turns to the high level. Mounting or fixing of the attachment is thus detected.

Figure 8:
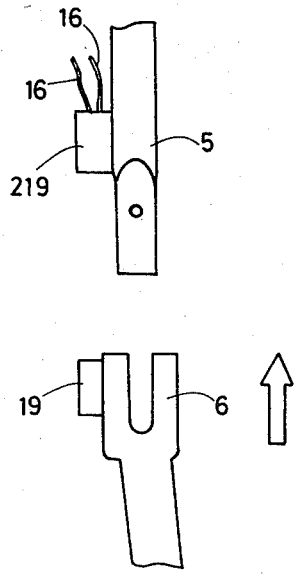
FIG. 8 is a diagrammatic view showing a preferred structure for detection.
Figure 7:
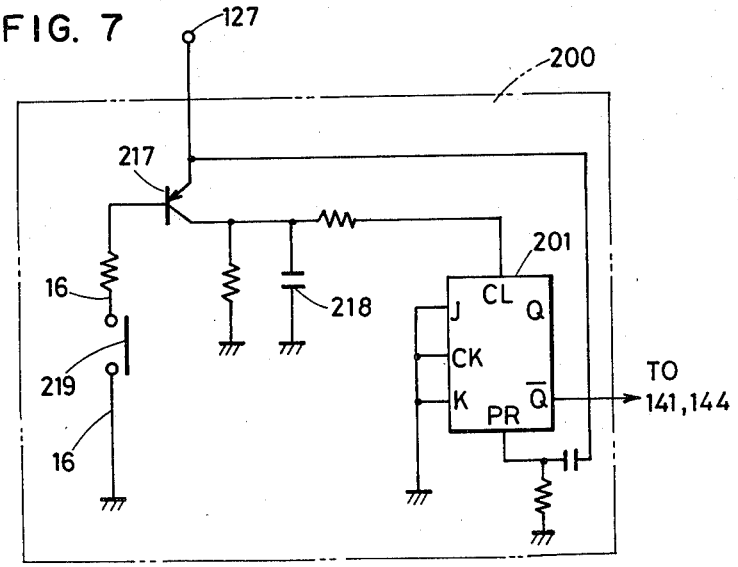
FIG. 7 is a schematic diagram of a further preferred embodiment of the detecting circuit.

FIG. 7 is a schematic diagram showing a further preferred embodiment of the detecting circuit. The FIG. 7 embodiment does not employ such a contact type plug and receptacle as employed in the previously described FIG. 5 embodiment. More specifically, the embodiment shown employs a magnet 19 fixed to the shank 6 and a magnet sensitive switch (such as a read switch or a Hall effect device) fixed to the presser bar 5 to be operable responsive to the magnet 19, as shown in FIG. 8. According to the embodiment shown in FIG. 8, i.e. in FIG. 7, mounting of the attachment can be detected on a non-contact basis. The magnet sensitive switch 219 is connected to the base circuit of the switching transistor 217. In the case of the embodiment shown, when the magnet 19 approaches the magnet sensitive switch 219, the base circuit of the switching transistor 217 is closed and accordingly the output $\overline{Q}$ of the flip-flop 201 turns to the high level. The structure and operation of other portions are the same as those in FIG. 7.

Meanwhile, although the above described embodiments were adapted such that the transistors 143 and 154 are controlled responsive to the output $\overline{Q}$ of the flip-flop 201, particularly in the case of the FIG. 3 embodiment, alternatively the output $\overline{Q}$ may be utilized, as is needless to say. Such modification could be designed with simplicity by those skilled in the art.

Furthermore, a variety of detecting circuits of the identical or similar structure other than those depicted herein can be designed with ease by those skilled in the art in conjunction with the embodiments of the detecting circuit described previously in conjunction with FIGS. 4 to 8.

Figure 9:
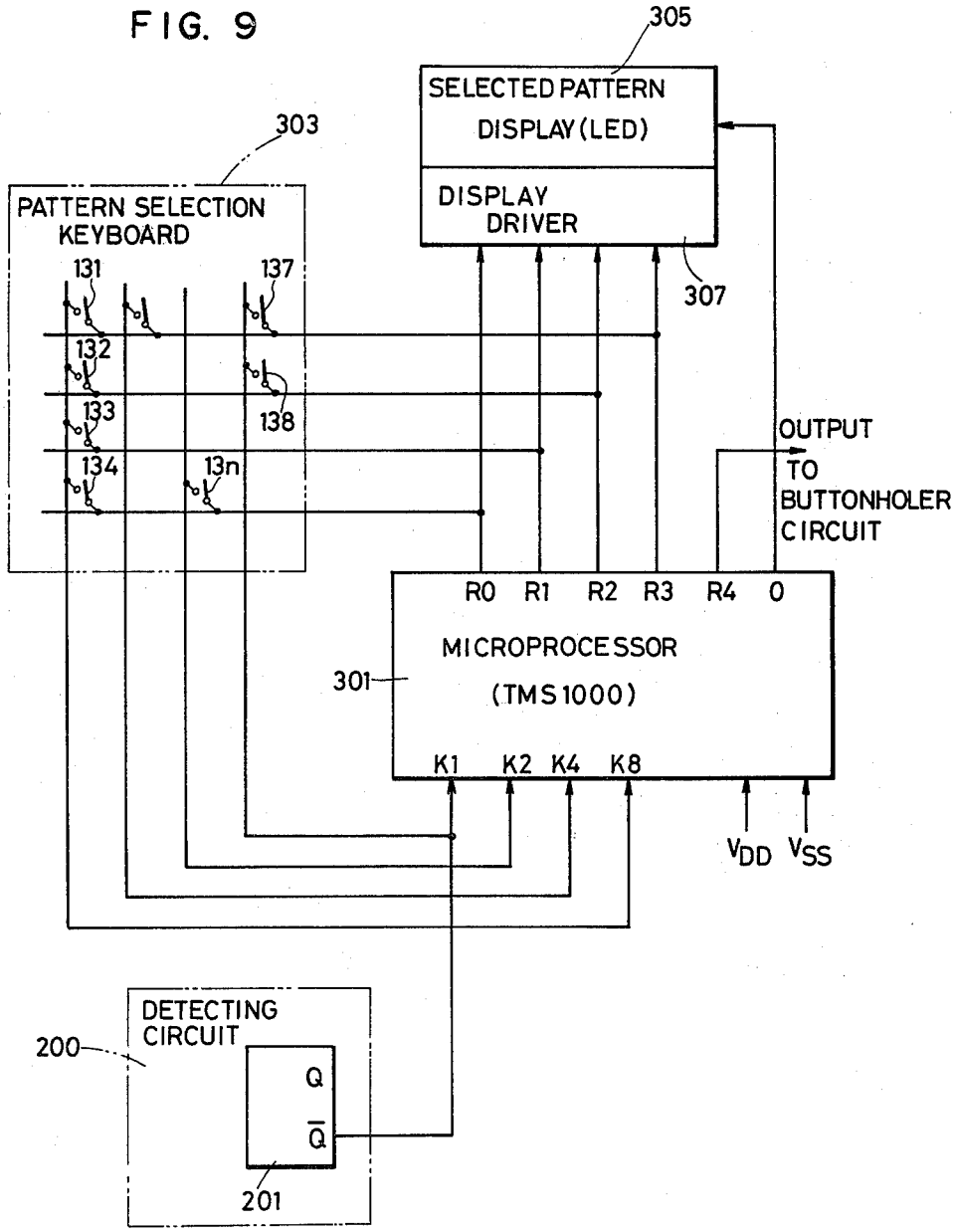
FIG. 9 is a block diagram showing another embodiment of the present invention employing a microprocessor.
Figure 10:
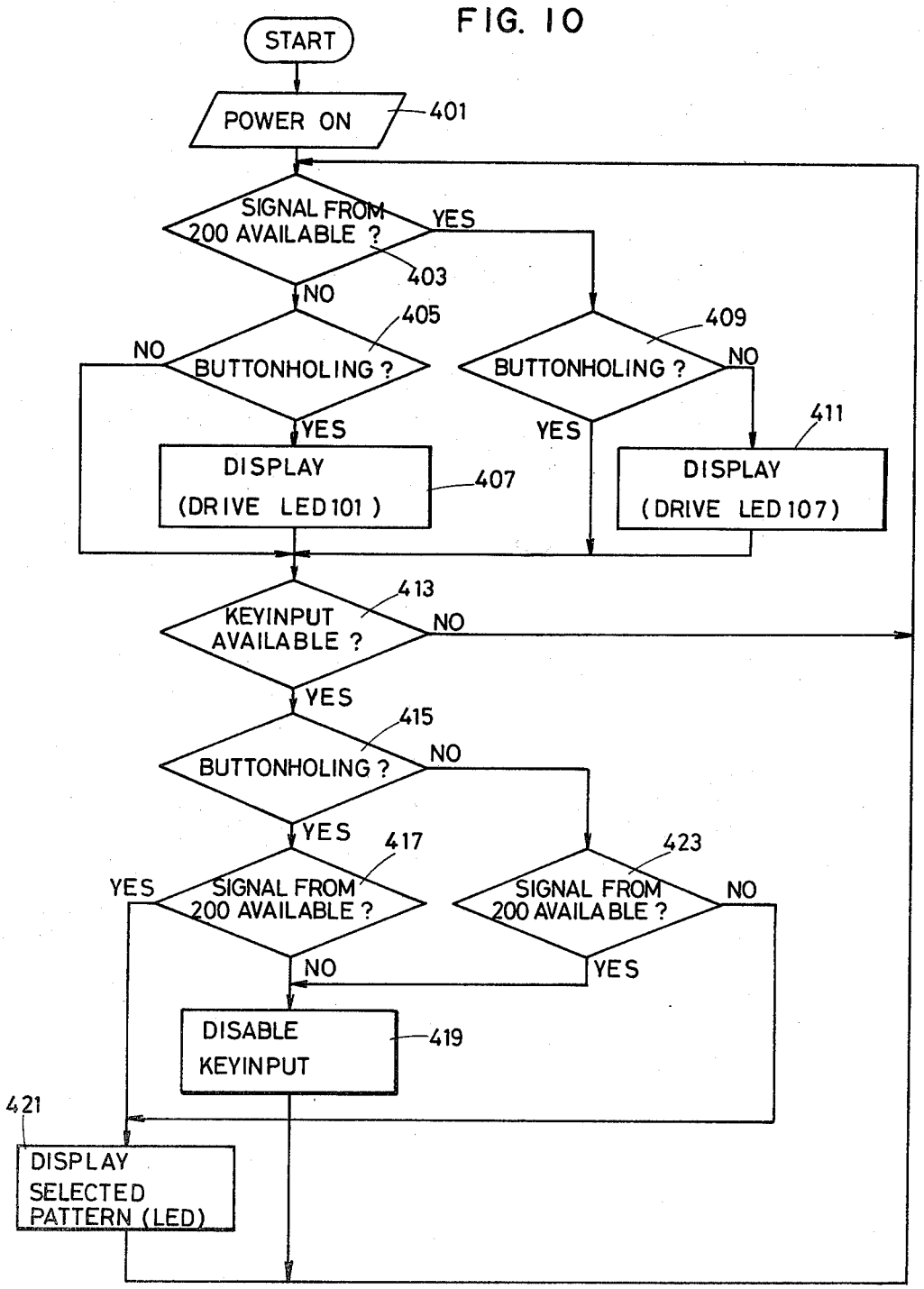
FIG. 10 is a flow diagram for describing an operation of the embodiment.

FIG. 9 is a block diagram showing another embodiment of the present invention employing a microprocessor. The embodiment shown employs a microprocessor 301, as is different from the previously described embodiment. A microprocessor or microcomputer that can be employed in the embodiment may comprise model TMS1000, manufactured by Texas Instruments, Incorporated, U.S.A., for example. The microprocessor 301 is connected to a pattern selection keyboard 303, a pattern display 305, a display driver 307 and a detecting circuit 200. The pattern selection keyboard 303 comprises a plurality of key switches 131 to 13*n*, as in the case of the previously described embodiment, in which the key switch 131 selects a straight stitch pattern, the key switch 132 selects a zigzag sewing pattern, and the key switch 133 selects a superzigzag sewing pattern. Furthermore, a key switch 137 selects buttonholing for a large diameter button and a key switch 138 selects buttonholing for a small diameter button. The signals from the pattern selection keyboard 303 including the key switches 131 to 13*n* are applied to the microprocessor 301 and also to the display driver 307. The microprocessor 301 receives a signal $\overline{Q}$ from a flip-flop 201 included in the detecting circuit 200 to process the same in accordance with a program as shown in FIG. 10. The selected pattern display 305 may be understood as comprising display elements such as the light emitting diodes 101 to 108 in the previously described FIG. 3 embodiment.

Now referring to FIG. 10, operation of the FIG. 9 embodiment will be briefly described. When an operator turns on a power supply at the step 401, the microprocessor 301 executes initialization of. Then at the step 403 the microprocessor 301 determines whether a signal from the detecting circuit 200, i.e. a signal representing that the attachment is mounted is available. If the attachment has not been mounted at that time, the microprocessor 301 further determines at the following step 405 whether the presently selected pattern is buttonholing. Since the attachment has not been mounted at that time even in the case of buttonholing, the microprocessor 301 determines that buttonholing is incapable and at the following step 407 drives the light emitting diodes included in the display 305 to display a straight stitch mode. The reason is that in, case of patterns other than the buttonholing the straight stitch is preferred.

If a signal for detecting that the attachment is mounted is available at the previous determining step 403, the microprocessor 301 determines at the following step 409 whether the set or selected mode is buttonholing. If and when the buttonholing mode has been selected, no change occurs, whereas if and when the buttonholing mode has not been selected, the light emitting diodes 107 included in the display 305 are driven to display the buttonhole (large). The reason is that in, the buttonholing mode the buttonhole (large) mode is preferred.

After the steps 405, 407, 409 and 411, the microprocessor 301 detects at the following step 413 whether a key input is available from the pattern selection keyboard 303. In the absence of key entry, the previously described processing is repeated.

In the case of key entry, it is determined at the step 415 whether the key entry is for setting the buttonholing mode, i.e. whether the key entry is from the key switch 137 of 138. If and when the buttonholing mode has been selected, the microprocessor 301 determines at the following step 417 whether a signal from the detecting circuit 200 is available, i.e. whether the attachment has been mounted. If the attachment has not been mounted, since the buttonholing mode is not enabled, the key entry is disabled at the step 419. Conversely, if and when the signal $\overline{Q}$ has been entered at the step 417, at the following step 421 the microprocessor 301 displays the selected pattern by the display 305 by driving the light emitting diodes. At the same time an output signal for such selected pattern, i.e. buttonholing, is obtained.

In the case where those patterns other than the buttonholing mode have been selected at the previous determining step 415, at the following step 423 the microprocessor 301 determines whether a signal from the detecting circuit 200 is available. In the presence of such signal at that time, i.e. if and when the attachment has been mounted, since those patterns other than buttonholing cannot be enabled in such state where the attachment has been mounted, key entry at that time is disabled at the step 419. If and when it is determined at the step 423 that the attachment has not been mounted, the selected pattern is displayed using the light emitting diodes at the step 421. Thus, according to the FIG. 9 embodiment as well, selection of the pattern modes between the buttonholing mode or those other than buttonholing is disabled responsive to presence or absence of the attachment being mounted.

As described in the foregoing, according to the present invention, operation of the selection switches of the pattern sewing are rendered ineffective when the attachment for the buttonholing is affixed. Accordingly, an operation in the pattern sewing mode with the attachment affixed is prevented. Therefore, the seam is prevented from becoming improper due to the fact that a needle has been mounted to such attachment. Furthermore, by adapting the embodiment such that the buttonholing selection switches are not rendered effective unless the attachment is affixed, operating mistakes are prevented from occurring.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An automatic buttonholing apparatus in a zigzag sewing machine, comprising:

selecting means including at least a pattern sewing selecting switch for selecting pattern sewing and a buttonholing selecting switch for selecting buttonholing, means for generating an electric signal corresponding, respectively, to operation of said pattern sewing selecting switch or of said buttonholing selecting switch, a presser bar means, an attachment affixed to said presser bar means for said buttonholing, detecting means for detecting that said attachment is affixed to said presser bar means, and means responsive to the output of said detecting means to act on said electric signal generating means for rendering ineffective the generation of the electric signal corresponding to the operation of said pattern sewing selecting switch.

2. An automatic buttonholing apparatus in a zigzag sewing machine in accordance with claim 1, wherein said controlling means comprises means responsive to the output of said detecting means for rendering effective an operation of said buttonholing selecting switch.

3. An automatic buttonholing apparatus in a zigzag sewing machine in accordance with claim 2, wherein said detecting means comprises a first member provided on said presser bar means, a second member provided on said attachment, and output means responsive to proximity or contact between said first member and said second member for providing said detected output from said detecting means.

4. An automatic buttonholing apparatus in a zigzag sewing machine in accordance with claim 3, wherein one of said first member and said second member comprises a plug and the other thereof comprises a receptacle of said plug.

5. An automatic buttonholing apparatus in a zigzag sewing machine in accordance with claim 3, wherein said first member and said second member constitute a proximity switch.

6. An automatic buttonholing apparatus in a zigzag sewing machine in accordance with claim 5, wherein one of said first member and said second member comprises a magnet and the other thereof comprises a magnet sensitive switch operable in response to said magnet.

7. An automatic buttonholing apparatus in a zigzag sewing machine in accordance with claim 4, wherein said attachment comprises a variable resistor the resistance value of which is changeable responsive to cloth feeding, said variable resistor being adapted to be inserted in a predetermined current path to establish said current path when said plug is connected to said receptacle, and said detecting means is adapted to provide said detected output from said detecting means as a function of a voltage drop occurring across said variable resistor.

8. An automatic buttonholing apparatus in a zigzag sewing machine in accordance with claim 7, wherein said predetermined current path comprises a voltage source, a reference potential, and a circuit portion formed between said voltage source and said reference potential for constituting said predetermined current path for allowing a current to flow from said voltage source through said variable resistor to said reference potential when said variable resistor is inserted, and said output means is adapted to provide said detected output from said detecting means responsive to a potential associated with said voltage drop occurring across said variable resistor.

9. An automatic buttonholing apparatus in a zigzag sewing machine in accordance with claim 4, wherein said detecting means comprises a short-circuiting member for closing a predetermined current path when said plug is connected to said receptacle, and said output means is adapted to provide said detected output from said detecting means responsive to a current flowing through said predetermined current path closed by said short-circuiting member.

10. An automatic buttonholing appratus in a zigzag sewing machine in accordance with claim 4, wherein said magnet sensitive switch is structured to establish a predetermined current path when the same is operable, and said output means is adapted to provide said detected output responsive to a current flowing through said predetermined current path established when said magnet sensitive switch is operable responsive to proximity of said magnet.

11. An automatic buttonholing apparatus in a zigzag sewing machine in accordance with claim 9 or 10, wherein said output means comprises a switching element which is rendered conductive or non-conductive when said predetermined current path is established and is adapted to provide said detected output from said detecting means responsive to conduction or non-conduction of said switching element.

12. An automatic buttonholing apparatus in a zigzag sewing in accordance with claim 1, wherein said buttonholing selecting switch comprises a first switch for a button of a relatively large diameter, and a second switch for a button of a relatively small diameter, and said controlling means is adapted to instantaneously rendering conductive said first switch responsive to said detected output from said detecting means.

13. An automatic buttonholing apparatus in a zigzag sewing machine, comprising:

selecting means including at least a pattern sewing selecting switch for selecting pattern sewing and a buttonholing selecting switch for selecting buttonholing for enabling corresponding sewing responsive to operation of either said pattern sewing selecting switch or said buttonholing selecting switch, a presser bar means, an attachment being affixed to said presser bar means for said buttonholing, detecting means for detecting that said attachment is affixed to said presser bar means, and controlling means responsive to the output of said detecting means for rendering ineffective an operation of said pattern sewing selecting switch, wherein said controlling means comprises state storing means, a state of which is controlled responsive to said detected output from said detecting means to provide a first output on a second output, said pattern sewing selecting switch is adapted to be rendered effective responsive to said first output of said state storing means and said buttonholing selecting switch is rendered effective responsive to said second output of said state storing means, and said state storing means being structured to provide said second output responsive to said detected output from said detecting means.

* * * * *